US010960671B2

(12) United States Patent
Hayashi et al.

(10) Patent No.: US 10,960,671 B2
(45) Date of Patent: Mar. 30, 2021

(54) LIQUID EJECTING HEAD INCLUDING FIRST PLATE, SECOND PLATE, AND PROTRUSION PROTRUDING FROM SECOND PLATE

(71) Applicant: BROTHER KOGYO KABUSHIKI KAISHA, Nagoya (JP)

(72) Inventors: Hideki Hayashi, Nagoya (JP); Taisuke Mizuno, Yokkaichi (JP); Keita Hirai, Nagoya (JP); Yuichi Ito, Mie-gun (JP)

(73) Assignee: BROTHER KOGYO KABUSHIKI KAISHA, Nagoya (JP)

( * ) Notice: Subject to any disclaimer, the term of this patent is extended or adjusted under 35 U.S.C. 154(b) by 0 days.

(21) Appl. No.: 16/551,068

(22) Filed: Aug. 26, 2019

(65) Prior Publication Data

US 2019/0375209 A1 Dec. 12, 2019

Related U.S. Application Data

(63) Continuation of application No. PCT/JP2018/010530, filed on Mar. 16, 2018.

(30) Foreign Application Priority Data

Mar. 29, 2017 (JP) ..... JP2017-065672

(51) Int. Cl.
*B41J 2/14* (2006.01)
*B41J 2/155* (2006.01)

(52) U.S. Cl.
CPC ..... *B41J 2/1433* (2013.01); *B41J 2/155* (2013.01)

(58) Field of Classification Search
CPC ..... B41J 2202/20; B41J 2/155; B41J 2002/14362; B41J 2/1433; B41J 2202/21
See application file for complete search history.

(56) References Cited

U.S. PATENT DOCUMENTS

| | | | |
|---|---|---|---|
| 2012/0038709 | A1 | 2/2012 | Owaki |
| 2015/0197090 | A1 | 7/2015 | Akahane |
| 2016/0067966 | A1 | 3/2016 | Akahane |
| 2016/0067972 | A1 | 3/2016 | Tanjo |
| 2016/0193835 | A1 | 7/2016 | Togashi et al. |

FOREIGN PATENT DOCUMENTS

| | | | |
|---|---|---|---|
| JP | 2016055449 | A | 4/2016 |
| JP | 2016155364 | a | 9/2016 |

OTHER PUBLICATIONS

International Preliminary Report on Patentability dated Oct. 1, 2019, together with the Written Opinion received in related International Application No. PCT/JP2018/010530.
International Search Report dated Aug. 6, 2018 issued in PCT/JP2018/010530.

*Primary Examiner* — Jannelle M Lebron
(74) *Attorney, Agent, or Firm* — Scully, Scott, Murphy & Presser, P.C.

(57) ABSTRACT

A liquid ejecting head includes: a plurality of liquid ejecting modules each including a plurality of head units and a first plate, a second plate, and a protrusion. The plurality of liquid ejecting modules is arrayed in a first direction. The first plate has a first surface to which the plurality of head units is fixed and a second surface opposite to the first surface. The first plate has a thickness in a second direction. The second plate is disposed at the second surface of the first plate so as to extend along the plurality of liquid ejecting modules. The protrusion protrudes from the second plate in a direction away from the first plate.

17 Claims, 10 Drawing Sheets

LIQUID EJECTING HEAD INCLUDING FIRST PLATE, SECOND PLATE, AND PROTRUSION PROTRUDING FROM SECOND PLATE

CROSS REFERENCE TO RELATED APPLICATION

This is a by-pass continuation application of International Application No. PCT/JP2018/010530 filed Mar. 16, 2018 claiming priority from Japanese Patent Application No. 2017-065672 filed Mar. 29, 2017. The entire contents of the International Application and the priority application are incorporated herein by reference.

TECHNICAL FIELD

The present disclosure relates to a liquid ejecting head that ejects liquid such as ink.

BACKGROUND

A liquid ejecting head provided with a plurality of liquid ejecting modules is known in the art. Each liquid ejecting module is configured of a plurality of head units, and a first plate to which the respective head units are fixed. Each head unit is fixed to a first surface of the corresponding first plate.

Each first plate has a second surface opposite to the first surface. A second plate is provided on the second surfaces of the first plates. The second plate is provided along a plurality of first plates. The second plate closes gaps provided between the first plates, thereby preventing ink from collecting in these gaps (see Japanese Patent Application Publication No. 2016-55449, for example).

SUMMARY

Each of the first plates and the second plate is formed with openings in communication with nozzles formed in the head units. However, in the conventional liquid ejecting head described above, damage to the nozzles may occur if a recording medium such as a paper enters these openings.

In view of the foregoing, it is an object of the present disclosure to provide a liquid ejecting head capable of suppressing damage to the nozzles.

In order to attain the above and other object, according to one aspect, the disclosure provides a liquid ejecting head including: a plurality of liquid ejecting modules each including a plurality of head units and a first plate, a second plate, and a protrusion. The plurality of liquid ejecting modules is arrayed in a first direction. The first plate has a first surface to which the plurality of head units is fixed and a second surface opposite to the first surface. The first plate has a thickness in a second direction. The second plate is disposed at the second surface of the first plate so as to extend along the plurality of liquid ejecting modules. The protrusion protrudes from the second plate in a direction away from the first plate.

BRIEF DESCRIPTION OF THE DRAWINGS

The particular features and advantages of the embodiment(s) as well as other objects will become apparent from the following description taken in connection with the accompanying drawings, in which.

DETAILED DESCRIPTION

First Embodiment

Figure 1:
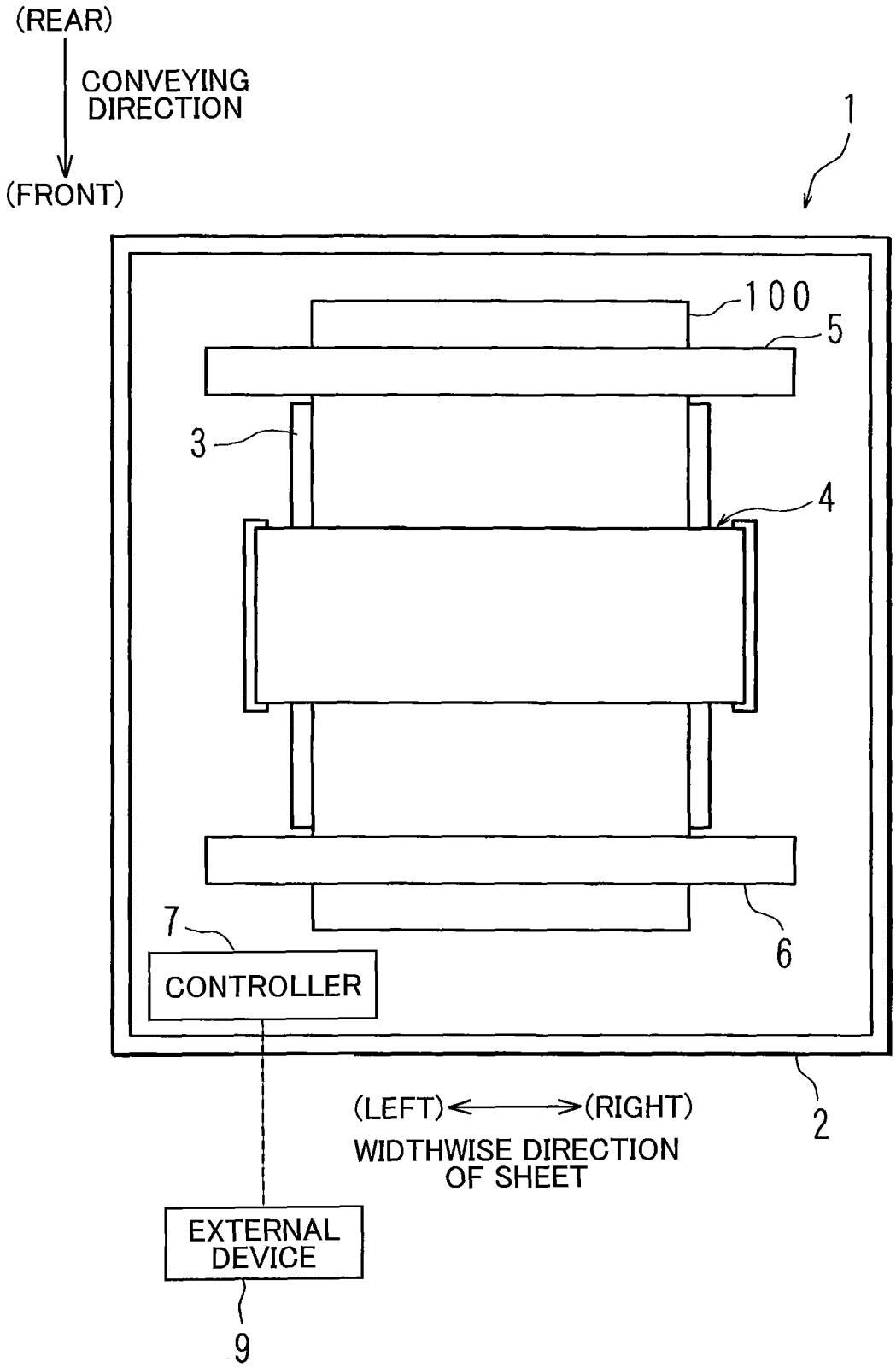
FIG. 1 is a schematic plan view of a printer 1 in which an inkjet head 4 according to a first embodiment of the present disclosure is provided.

Next, a printer 1 provided with an inkjet head 4 according to a first embodiment will be described with reference to FIGS. 1 to 4. In FIG. 1, a direction in which a recording sheet 100 is conveyed corresponds to a front-rear direction relative to the printer 1. In other words, the recording sheet 100 is conveyed from the rear side toward the front side in the printer 1. A direction in which a plurality of liquid ejecting modules 11 (see FIG. 2) arrayed corresponds to a left-right direction relative to the printer 1 (an example of a first direction). A widthwise direction of the recording sheet 100 also corresponds to the left-right direction. Further, a direction perpendicular to the front-rear direction and left-right direction, i.e., a direction perpendicular to a sheet surface of FIG. 1, corresponds to an up-down direction relative to the printer 1 (an example of a second direction).

As illustrated in FIG. 1, the printer 1 includes a casing 2, a platen 3, the inkjet head 4 (an example of a liquid ejecting head), two conveying rollers 5 and 6, and a controller 7 those accommodated in the casing 2.

When conveyed through the printer 1, the recording sheet 100 is supported to an upper surface of the platen 3. The inkjet head 4 is disposed upward of the platen 3. The inkjet head 4 is a line-type head, and has a plurality of nozzles 15 (see FIG. 2) arrayed in a direction parallel to a nozzle surface of a nozzle plate and intersecting both the front-rear direction and the left-right direction. Ink is supplied from ink tanks (not illustrated) to the inkjet head 4. That is, ink in a plurality of different colors is supplied to the inkjet head 4.

As illustrated in FIG. 1, the conveying roller 5 is positioned rearward of the platen 3 and the conveying roller 6 is positioned frontward of the platen 3. A motor (not illustrated) provided in the printer 1 drives the conveying rollers 5 and 6 to convey the recording sheet 100 frontward over the platen 3.

The controller 7 is provided with a CPU (central processing unit), an ROM (read-only memory), an RAM (random access memory), and an ASIC (application-specific integrated circuit) that includes various control circuits. The controller 7 is connected to an external device 9, such as a personal computer, and can perform data communications with the external device 9. The controller 7 controls components in the printer 1 on the basis of print data received from the external device 9.

More specifically, the controller 7 controls the motor that drives the conveying rollers 5 and 6 to convey the recording sheet 100 in a conveying direction. At the same time, the controller 7 controls the inkjet head 4 to eject ink toward the recording sheet 100, whereby an image is formed on the recording sheet 100.

Figure 2:
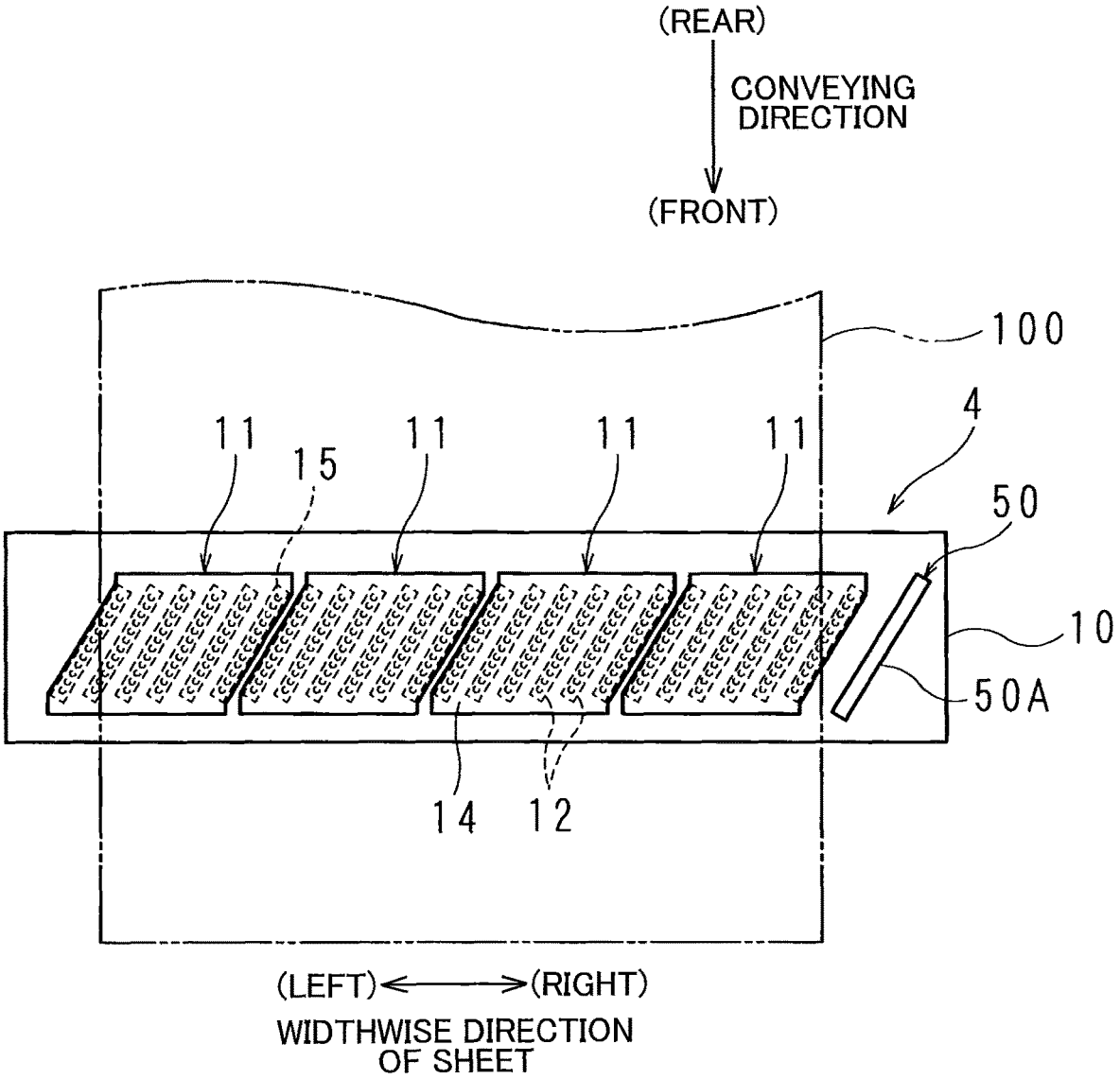
FIG. 2 is a schematic plan view of the inkjet head 4 according to the first embodiment.

As illustrated in FIG. 2, the inkjet head 4 is provided with a retaining plate 10 and four liquid ejecting modules 11. The four liquid ejecting modules 11 are arrayed in the left-right direction and are mounted on the retaining plate 10. The liquid ejecting modules 11 are connected to common ink tanks (not illustrated) via ink supply holes (not illustrated) formed in a holder 14.

Figure 3:
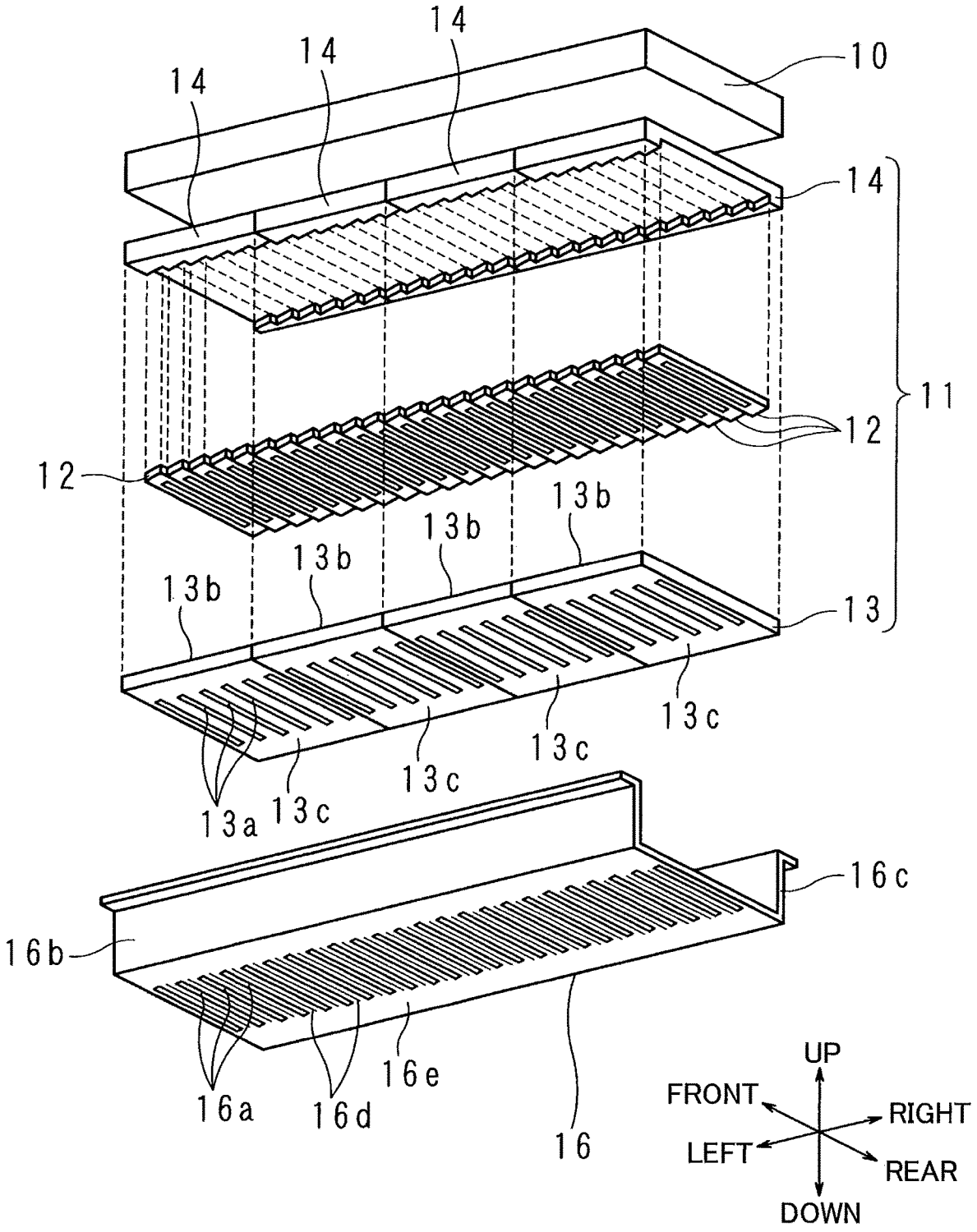
FIG. 3 is a schematic exploded perspective view of a liquid ejecting module 11 and a second plate 16 in the inkjet head 4 according to the first embodiment.

As illustrated in FIG. 3, each of the liquid ejecting modules 11 is provided with six head units 12, a first plate 13, and the holder 14. Each head unit 12 has a rectangular planar shape. A plurality of nozzles 15 is formed in a lower surface of each head unit 12. The nozzles 15 are aligned in a longitudinal direction of each head unit 12. Each head unit 12 is disposed obliquely so that the longitudinal direction of the head unit 12 intersects both the left-right direction and the front-rear direction. The six head units 12 in each liquid ejecting module 11 are arrayed in the left-right direction.

The six head units 12 of each liquid ejecting module 11 are fixed to an upper surface 13*b* (an example of a first surface) of the corresponding first plate 13. The first plate 13 is formed with six first openings 13*a* that penetrate the first plate 13 in the up-down direction. The first openings 13*a* extend obliquely relative to the front-rear direction and are arrayed in the left-right direction. The six first openings 13*a* are arrayed in correspondence with the six head units 12. The nozzles 15 and the corresponding first openings 13*a* are overlapped with each other in the up-down direction (i.e., a thickness direction of the first plate 13). The holder 14 has a plate shape and has a lower surface that retains the six head units 12.

A second plate 16 is provided below the four liquid ejecting modules 11. The second plate 16 has a rectangular shape that extends in the left-right direction along the four liquid ejecting modules 11. The second plate 16 has a front edge 16*b* and a rear edge 16*c* that are both bent upward. The four liquid ejecting modules 11 are interposed between the front edge 16*b* and rear edge 16*c* in the front-rear direction.

The second plate 16 has a lower surface 16*e*, and a plurality of second openings 16*a* that penetrate the second plate 16 in the up-down direction. The second openings 16*a* are arrayed in the left-right direction. As with the first openings 13*a*, the second openings 16*a* extend obliquely relative to the front-rear direction. The second openings 16*a* are arranged at positions in the left-right direction that are approximately the same as the positions of the first openings 13*a* in the four first plates 13. Thus, the second openings 16*a* and the first openings 13*a* are overlapped with each other in the up-down direction (i.e., the thickness direction of the first plates 13). Each second opening 16*a* has dimensions in the left-right direction and the front-rear direction greater than those of each first opening 13*a*. In other words, an area of each second opening 16*a* is greater than an area of each first opening 13*a* in a plan view. A lower surface 13*c* (an example of a second surface) of each first plate 13 is opposite to the upper surface 13*b* and fixed to an upper surface of the second plate 16. Protrusions 16*d* (described later) are provided on the lower surface 16*e* of the second plate 16. Each protrusion 16*d* is disposed between the neighboring second openings 16*a*.

Figure 4:
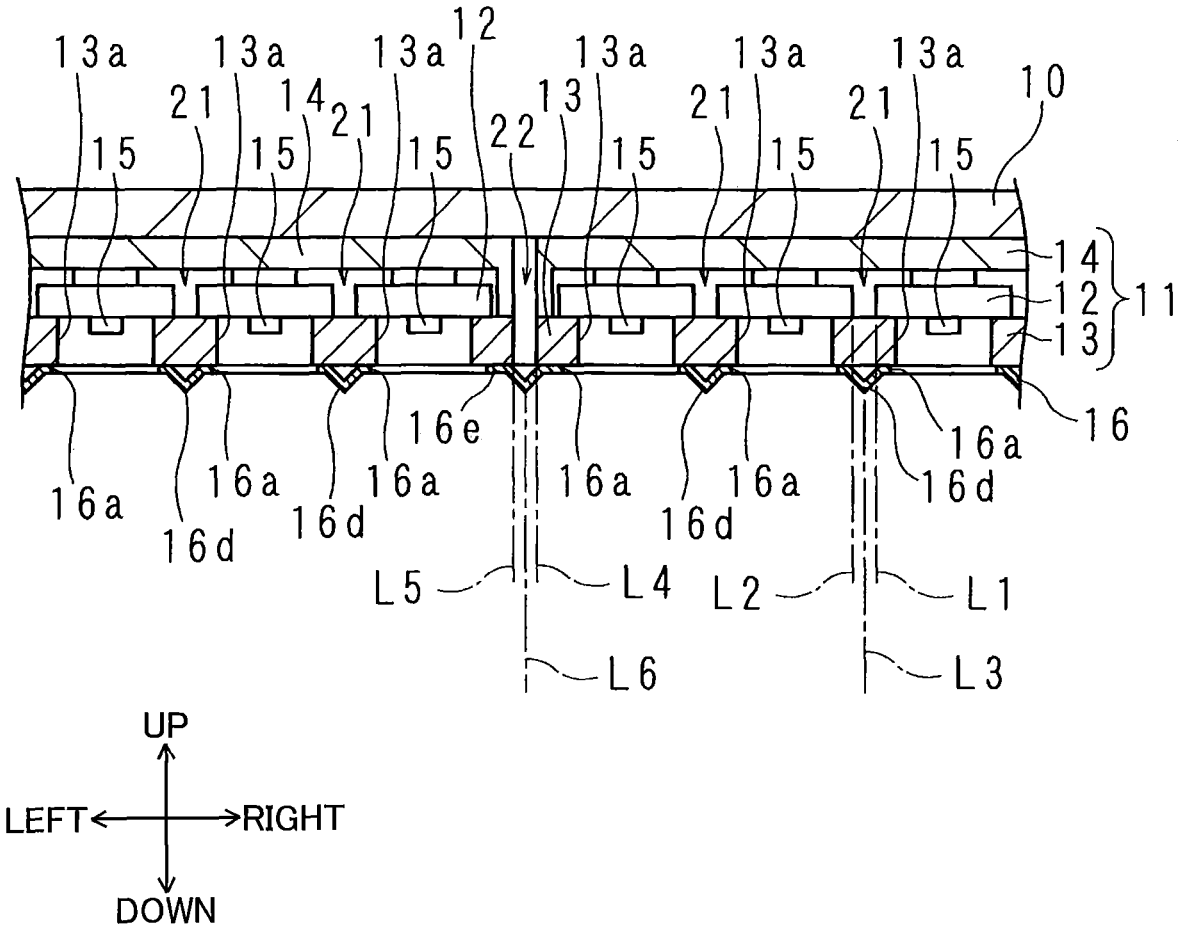
FIG. 4 is a schematic enlarged front cross-sectional view of a part of the liquid ejecting module 11 and the second plate 16 in the inkjet head 4 according to the first embodiment.

As illustrated in FIG. 4, outlines defining the first openings 13*a* and outlines defining the second openings 16*a* are positioned below the head units 12. That is, the outlines defining the first openings 13*a* and the outlines defining the second openings 16*a* overlap the head units 12 in the thickness directions of the first plates 13 and the second plate 16.

The plurality of protrusions 16*d* is provided on the lower surface 16*e* of the second plate 16 to protrude downward therefrom. Each protrusion 16*d* is disposed at a position between the neighboring second opening 16*a*. The protrusions 16*d* are integrally formed with the second plate 16. The protrusions 16*d* are formed in the second plate 16 through a raising (metalworking) technique, for example.

A first gap 21 is formed between the neighboring head units 12. If lines extending in the up-down direction along edges opposed to each other in two neighboring head units 12 are called extension lines L1 and L2, the first gap 21 is formed between the extension lines L1 and L2.

Some of the protrusions 16*d* are provided directly below the first gaps 21. If a line extending in the up-down direction through the left-right center of the protrusion 16*d* is called an extension line L3, the extension line L3 is positioned in the approximate left-right center between the extension lines L1 and L2. In other words, the protrusions 16*d* overlap the first gaps 21 in the up-down direction (the thickness direction of the first plates 13).

A second gap 22 is formed between the neighboring liquid ejecting modules 11. If lines extending in the up-down direction along edges opposed to each other in the two neighboring liquid ejecting modules 11 are called extension lines L4 and L5, the second gap 22 is formed between the extension lines L4 and L5.

Some of the protrusions 16*d* are provided directly below the second gaps 22. If a line extending in the up-down direction through the left-right center of this protrusion 16*d* is called an extension line L6, the extension line L6 is positioned in the approximate left-right center between the extension lines L4 and L5. In other words, the protrusions 16*d* overlap the second gaps 22 in the up-down direction (the thickness direction of the first plates 13).

In the printer 1 according to the first embodiment, since the protrusions 16*d* are formed on the second plate 16 to protrude downward therefrom, a predetermined distance is provided between the recording sheet 100 and the second openings 16*a* of the second plate 16. Thus, the protrusions 16*d* can prevent the recording sheet 100 from entering the second openings 16*a*, thereby avoiding damage to the nozzles 15.

Further, the nozzles 15, the first openings 13*a*, and the second openings 16*a* are overlapped with each other in the up-down direction. With this configuration, ink can be smoothly ejected through the nozzles 15.

Further, the outlines defining the first openings 13*a* and the outlines defining the second openings 16*a* overlap the head units 12 in the up-down direction. Accordingly, it is easy to apply load to the first plates 13 and second plate 16 in the manufacturing process for pressing the first plates 13 and second plate 16 up and down, thereby facilitating an operation for adhesively bonding the first plates 13 to the second plate 16.

Further, positional offset between the second plate 16 and first plates 13 may occur when the second plate 16 and first plates 13 are assembled together. However, since the area of each second opening 16*a* is larger than the area of each first opening 13*a*, the first openings 13*a* can easily be positioned inside the second openings 16*a* in a bottom view. This configuration can prevent the first openings 13*a* from being obstructed.

During the manufacturing process, a force directed downward is applied to the retaining plate 10 and a force directed upward is applied to the second plate 16 to press the first plates 13 and second plate 16 against each other in the up-down direction. At this time, a jig is disposed below the second plate 16. A plurality of through-holes in which the protrusions 16*d* are inserted is formed in the jig. After inserting the protrusions 16*d* into the corresponding through-holes, a force directed upward is applied to the second plate 16 through the jig. Since the protrusions 16*d* are provided directly below the first gaps 21, the jig overlaps the head units 12 in the up-down direction but does not overlap the first gaps 21. Accordingly, since the first plates 13 and the second plate 16 are interposed between the jig and the head units 12, the first plates 13 and second plate 16 can easily be bonded with the head units 12.

Further, since the protrusions 16*d* are provided directly below the second gaps 22, the jig overlaps the retaining plate 10 in the up-down direction without overlapping the second gaps 22 in the up-down direction. Accordingly, since the liquid ejecting modules 11 and the second plate 16 are interposed between the jig and the retaining plate 10, the liquid ejecting modules 11 can easily be bonded to the second plate 16. Further, since the head units 12 overlap the first plates 13 and second plate 16 in the up-down direction and do not overlap the second gaps 22, the head units 12 can be closely fixed to the first plates 13 and the second plate 16.

Second Embodiment

Figure 5:
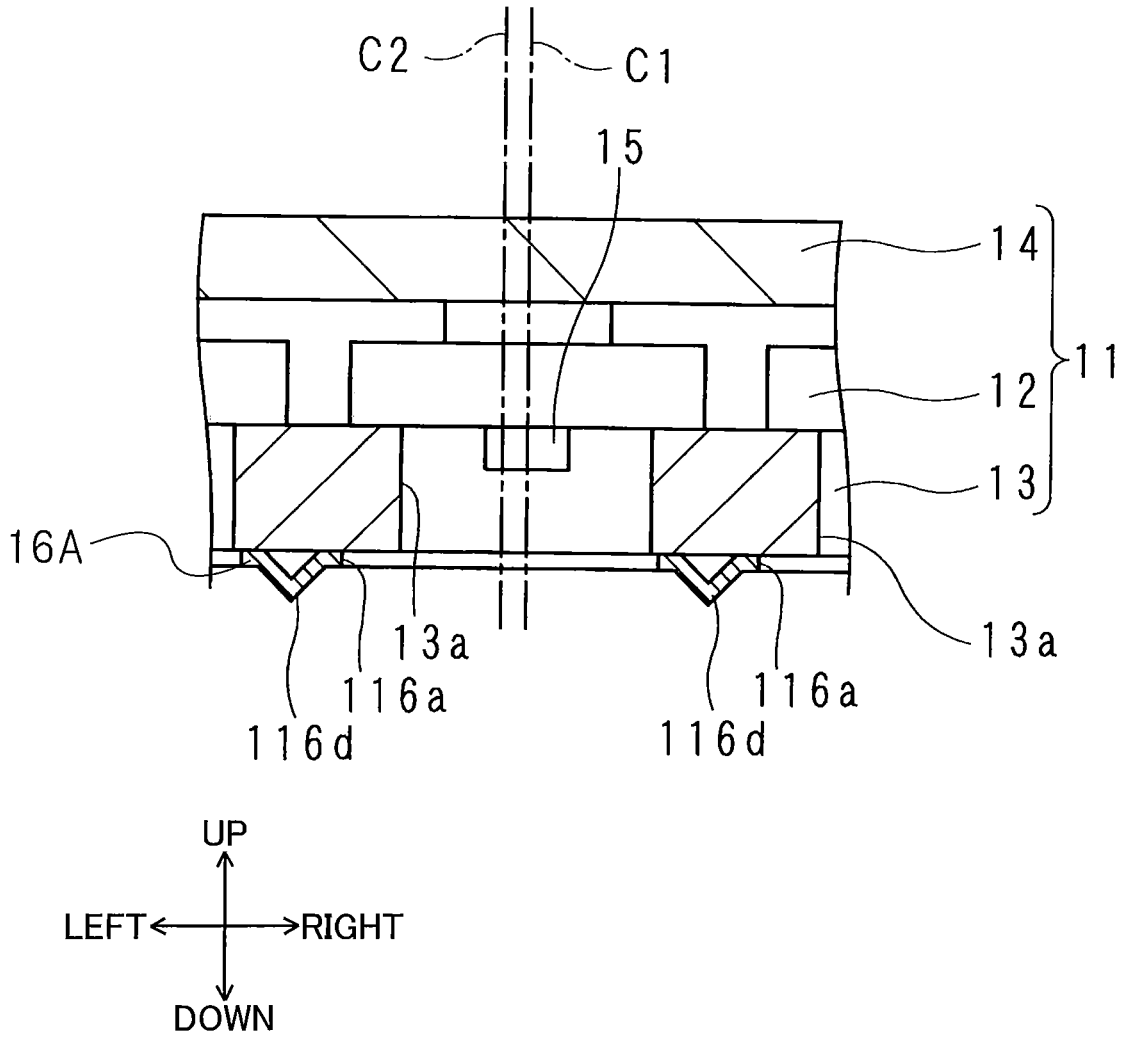
FIG. 5 is a schematic enlarged front cross-sectional view of a part of the liquid ejecting module 11 and a second plate 16A in an inkjet head 4 according to a second embodiment.

Next, a second plate 16A in an inkjet head 4 according to a second embodiment will be described with reference to FIG. 5. If C1 is a central axis denoting the left-right center position of the first opening 13*a* and C2 is a central axis denoting the left-right center position of a second opening 116*a* formed in the second plate 16A, then the central axis C2 parallel to the up-down direction is offset either rightward or leftward from the central axis C1 parallel to the up-down direction (leftward in the second embodiment). Since the central axis C2 is offset from the central axis C1 in the left-right direction, protrusions 116*d* protruding downward from the second plate 16A are also offset. Note that while the protrusions 16*d* in the first embodiment are formed integrally with the second plate 16, the protrusions 116*d* in the second embodiment are formed separately from the second plate 16A. The protrusions 116*d* are formed from a resin material using a potting method, for example.

In other words, the central axis C2 is offset from the central axis C1 in an arraying direction of the liquid ejecting modules 11. Thus, if the second opening 116*a* has two open area with respect to the central axis C1, the open area of the second opening 116*a* containing the central axis C2 (i.e., the open area positioned leftward relative to the central axis C1) is greater than the open area of the second opening 116*a* on the opposite side (i.e., the open area positioned rightward relative to the central axis C1).

As illustrated in FIG. 2, the printer 1 is also provided with a wiping unit 50. The wiping unit 50 removes ink or foreign matter deposited on the nozzles 15 at a suitable timing. More specifically, the wiping unit 50 removes this ink or foreign matter by moving a wiper blade 50A toward the nozzles 15 from the central axis C1 side (upstream side in a moving direction of the wiper blade 50A) to the central axis C2 side (downstream side in the moving direction of the wiper blade 50A). That is, the open area of the second opening 116*a* on the downstream side in the moving direction of the wiper blade 50A is greater than the open area on the upstream side with respect to the central axis C1.

Since the open area of the second opening 116*a* on the downstream side in the moving direction of the wiper blade 50A is greater than the open area of the second opening 116*a* on the upstream side with respect to the central axis C1 in the second plate 16A according to the second embodiment, a sufficient space in the second opening 116*a* is allocated downstream side of the nozzles 15 for transferring ink or foreign matter away from the nozzles 15, thereby enabling the ink or foreign matter to be easily scraped away from the nozzles 15.

Note that parts and components in the second embodiment having the same structure as those in the first embodiment are designated with the same reference numerals to avoid duplicating description.

Third Embodiment

Figure 6:
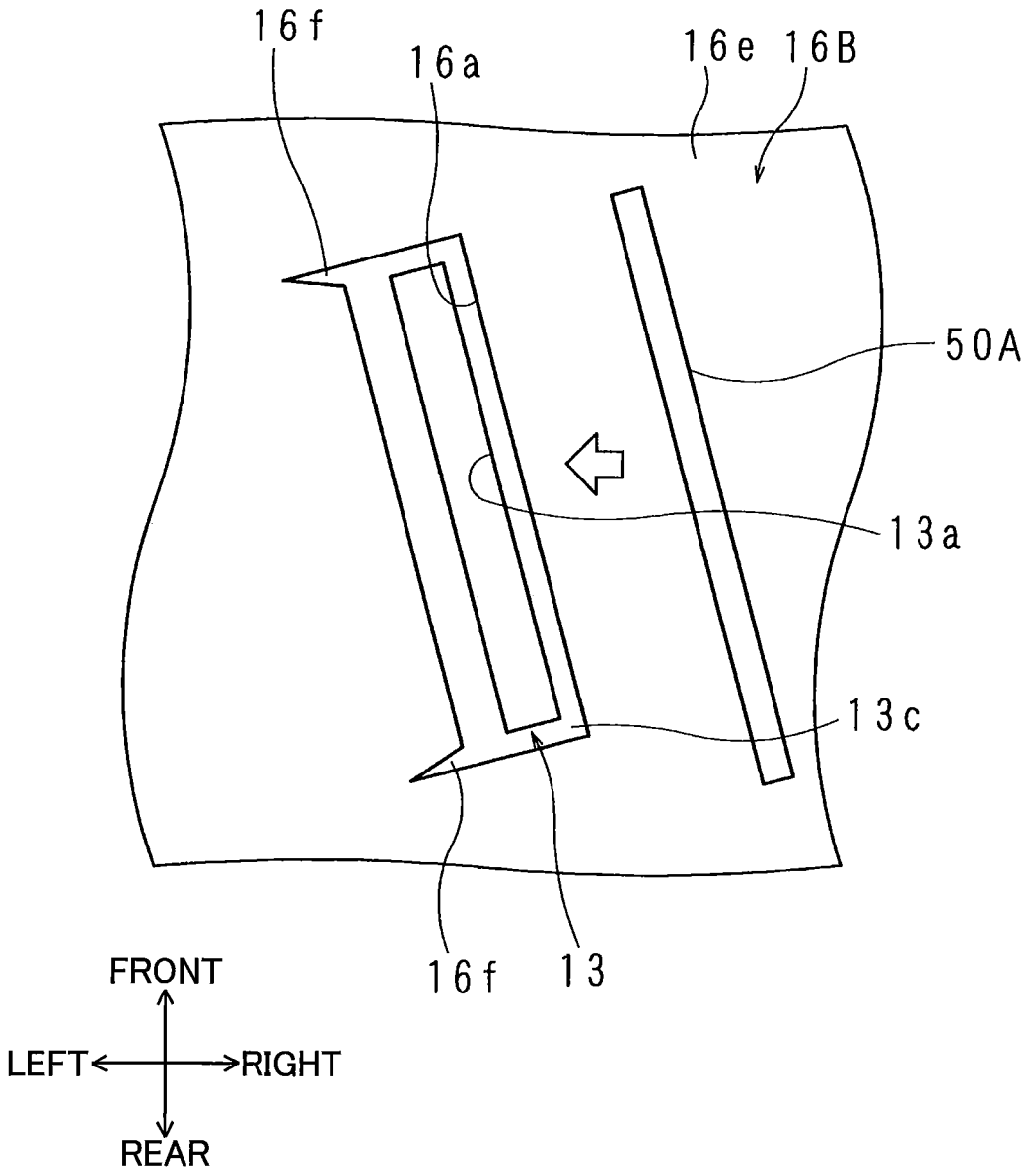
FIG. 6 is a schematic partial enlarged bottom view illustrating a second opening 16*a* of a second plate 16B in an inkjet head 4 according to a third embodiment.

Next, a second plate 16B in an inkjet head 4 according to a third embodiment will be described with reference to FIG. 6. Similar to the second embodiment, the open area of the second opening 16*a* on the left side relative to the left-right center of the first opening 13*a* is greater than the open area of the second opening 16*a* on the right side. The wiping unit 50 moves the wiper blade 50A toward the nozzles 15 from the right side (upstream side) to the left side (downstream side). That is, the open area of the second opening 16*a* on the downstream side in the moving direction of the wiper blade 50A is greater than the open area of the second opening 16*a* on the upstream side with respect to the left-right center of the first opening 13*a*.

The second plate 16B is formed with third openings 16*f* that penetrate the second plate 16B in the up-down direction. One third opening 16*f* is in communication with a left end of each second opening 16*a* at the front end thereof, and another third opening 16*f* is in communication with the left end of each second opening 16*a* at the rear end thereof. That is, the third opening 16*f* is open at each end portion of the second opening 16*a* in a direction in which the plurality of nozzles 15 are arrayed. Each third opening 16*f* has a triangular shape in a bottom view. One side of each triangular-shaped third opening 16*f* communicates with the second opening 16*a*, and a vertex opposite to this side is positioned leftward of this side. The third openings 16*f* have dimensions in the front-rear direction that narrows toward the vertex, i.e., toward the downstream side in the moving direction of the wiper blade 50A.

In the second plate 16B according to the third embodiment, ink or foreign matter separated from the nozzles 15 can be transferred to the third openings 16*f* and, hence, can be quickly taken out of the second opening 16*a*. Further, since the dimension in the front-rear direction of each third opening 16*f* narrow toward the downstream end in the moving direction of the wiper blade 50A, ink is naturally scraped out through the third openings 16*f* while moving downstream. Note that each third opening 16*f* need not have a triangular shape, but may have a circular or square shape, for example.

Alternatively, if the wiper blade 50A moves from the left side toward the right side in the printer 1, the open area of the second opening 16*a* on the right side should be greater than the open area on the left side, and the third openings 16*f* should be formed so as to communicate with a right end of the second opening 16*a*, with one on the front end and one on the rear end thereof.

Note that parts and components in the third embodiment having the same structure as those in the first or second embodiment are designated with the same reference numerals to avoid duplicating description.

Fourth Embodiment

Figure 7:
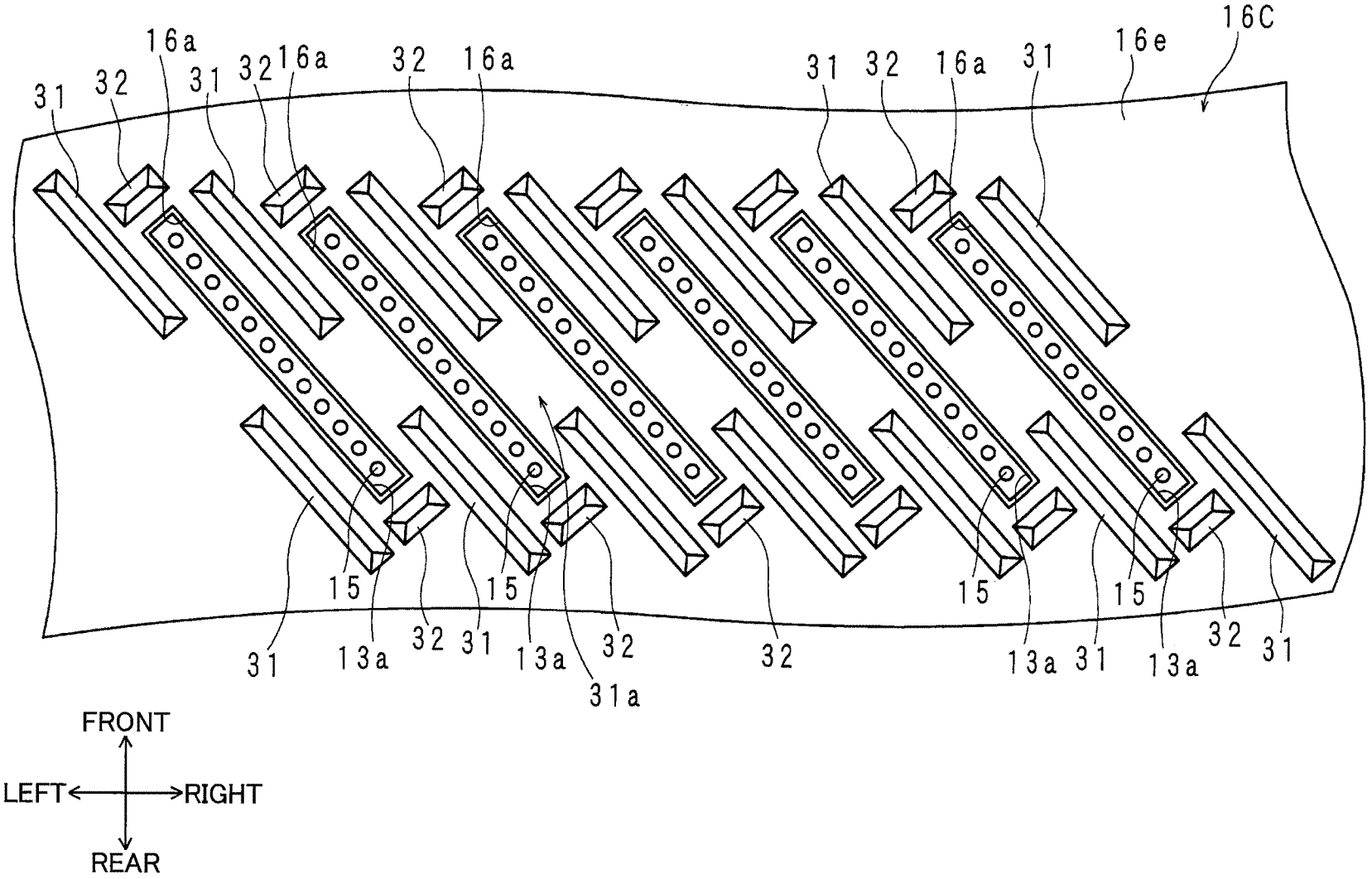
FIG. 7 is a schematic bottom view of a second plate 16C in an inkjet head 4 according to a fourth embodiment.

Next, a second plate 16C in an inkjet head 4 according to a fourth embodiment will be described with reference to FIG. 7. As illustrated in FIG. 7, the printer 1 includes the second plate 16C. A plurality of nozzles 15 is disposed inward of each second opening 16*a* in a bottom view. The nozzles 15 form nozzle rows that extend in a longitudinal direction of the second opening 16*a*. The longitudinal direction of the second opening 16*a* is an example of a predetermined direction.

A plurality of first protrusions 31 (an example of a protrusion and a first protruding portion) is provided on the lower surface 16*e* of the second plate 16C. The first protrusions 31 are disposed between the neighboring second openings 16*a*, at the right side of the rightmost second opening 16*a*, and at the left side of the leftmost second opening 16*a*.

The first protrusions 31 extend in the longitudinal direction of the second openings 16*a* along the nozzle rows. A pair of first protrusions 31 is arranged with a gap 31*a* formed therebetween at a position between the neighboring second openings 16*a*, at the right side of the rightmost second opening 16*a*, and at the left side of the leftmost second opening 16*a*.

A plurality of second protrusions 32 (another example of the protrusion) is also provided on the lower surface 16*e* of the second plate 16C. The two second protrusions 32 are respectively disposed outward of a front end and a rear end of each second opening 16*a* in the longitudinal direction of the second opening 16*a*. In other words, each second protrusion 32 is positioned outward of each end portion of the nozzle row in the longitudinal direction of the second opening 16*a*.

Since the first protrusions 31 extend along the nozzle rows, a single first protrusion 31 can protect multiple nozzles 15, thereby efficiently preventing damage to the nozzles 15.

Airflow along the front-rear direction is produced when the recording sheet 100 is conveyed. Ink ejected from the nozzles 15 may be affected by this airflow, resulting in ink droplets impacting the recording sheet 100 at positions deviating from the target positions. In the printer 1 according to the fourth embodiment, some of this airflow is circulated through the gaps 31*a* and flows in a direction perpendicular to the front-rear direction. Accordingly, this arrangement can reduce the strength of the air flowing in the front-rear direction.

Further, since the second protrusions 32 are provided at positions outward of the front end and rear end of each second opening 16*a*, each second protrusion 32 is positioned on the upstream side of the second opening 16*a* in the conveying direction of the recording sheet 100, regardless of whether the recording sheet 100 is conveyed in the normal direction (frontward direction) or the reverse direction (rearward direction). Hence, even if the recording sheet 100 rises off the platen 3 while being conveyed so that an edge of the recording sheet 100 turns toward the nozzles 15, the edge of the recording sheet 100 will more likely contact the second protrusions 32 than the nozzles 15.

Note that parts and components in the fourth embodiment having the same structure as those in the first to third embodiments are designated with the same reference numerals to avoid duplicating description.

Fifth Embodiment

Figure 8:
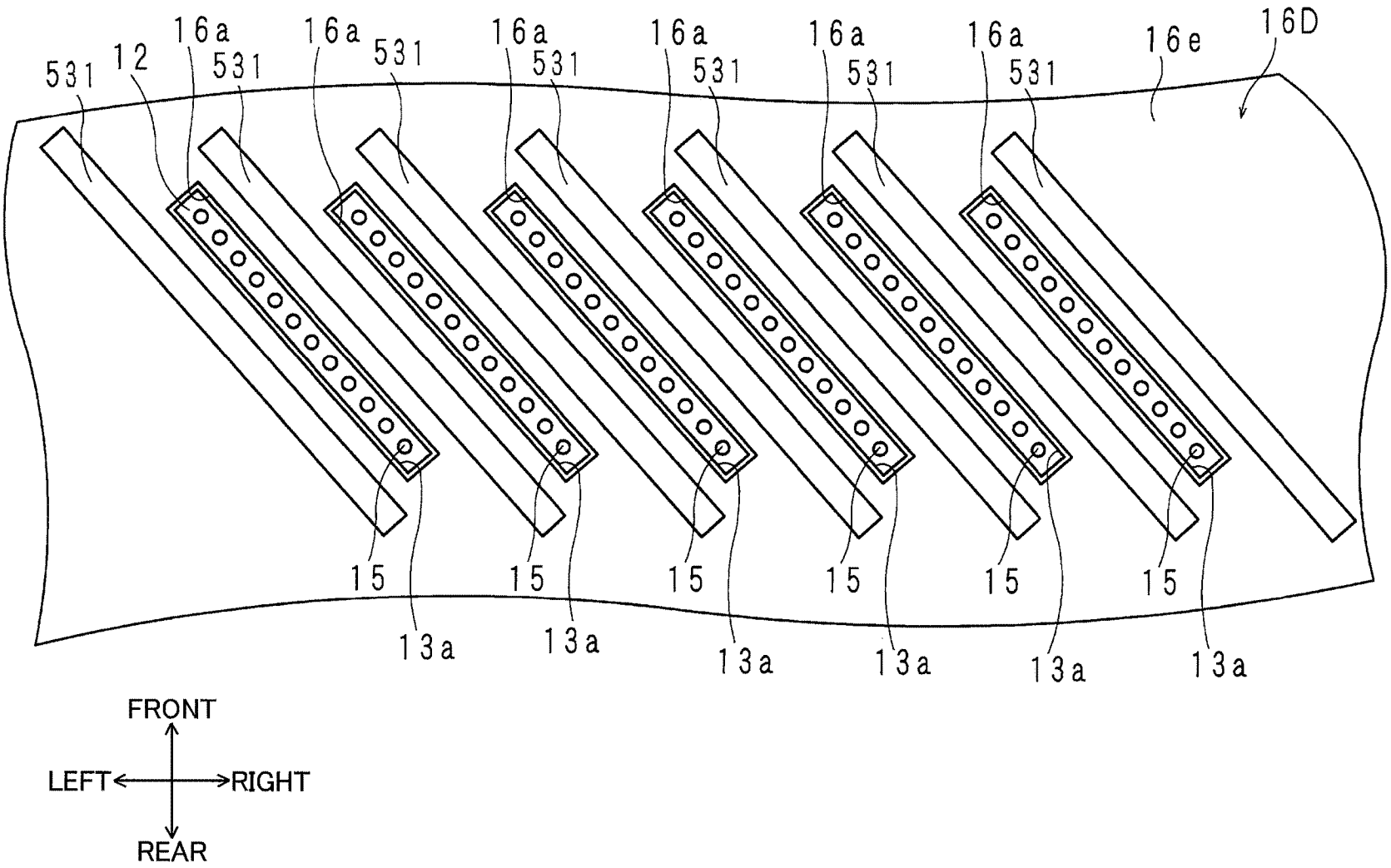
FIG. 8 is a schematic bottom view of a second plate 16D in an inkjet head 4 according to a fifth embodiment.

Next, a second plate 16D in an inkjet head 4 according to a fifth embodiment will be described with reference to FIG. 8. As illustrated in FIG. 8, first protrusions 531 (an example of a protrusion) extend in the longitudinal direction of the second opening 16*a*. Front ends of the first protrusions 531 are positioned frontward of the frontmost nozzle 15 in each nozzle row. Similarly, rear ends of the first protrusions 531 are positioned rearward of the rearmost nozzle 15 in each nozzle row. In other words, the first protrusions 531 extend outward of the head units 12 in the longitudinal direction of the second openings 16*a*.

In the second plate 16D according to the fifth embodiment, the ends of the first protrusions 531 in the longitudinal direction of the second opening 16*a* are disposed on the upstream side of the second openings 16*a* in the conveying direction of the recording sheet 100, regardless of whether the recording sheet 100 is conveyed in the normal direction (frontward direction) or reverse direction (rearward direction). Hence, even if the recording sheet 100 rises off the platen 3 while being conveyed so that the edge of the recording sheet 100 turns toward the nozzles 15, the edge of the recording sheet 100 will more likely contact the ends of the first protrusions 531 than the nozzles 15.

Note that parts and components in the fifth embodiment having the same structure as those in the first to fourth embodiments are designated with the same reference numerals to avoid duplicating description.

Sixth Embodiment

Figure 9:
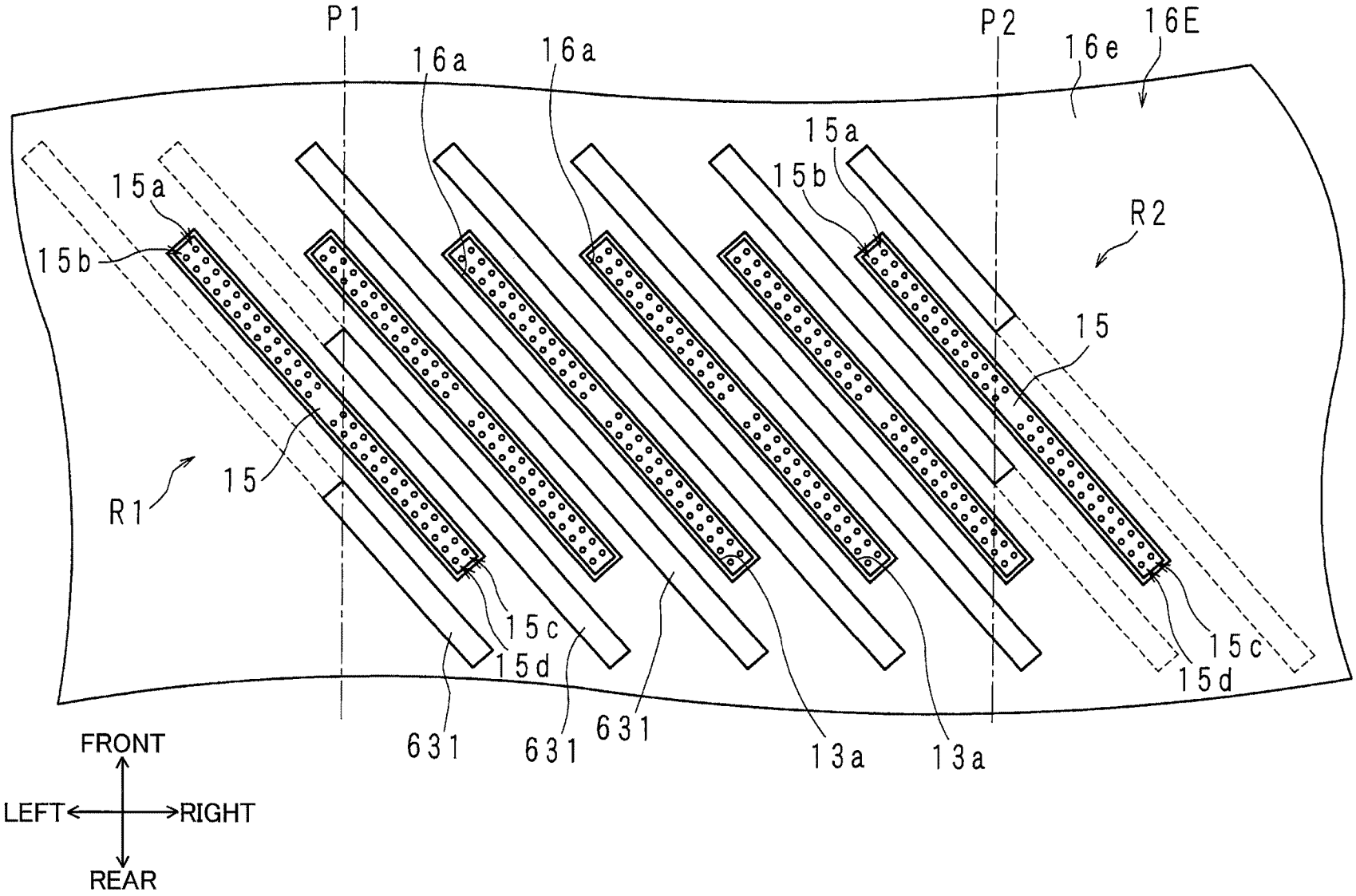
FIG. 9 is a schematic bottom view of a second plate 16E in an inkjet head 4 according to a sixth embodiment.

Next, a second plate 16E in an inkjet head 4 according to a sixth embodiment will be described with reference to FIG. 9. As illustrated in FIG. 9, the printer 1 includes the second plate 16E. In addition, a first nozzle row 15*a* arrayed in a right-front region, a second nozzle row 15*b* arrayed in the left-front region, a third nozzle row 15*c* arrayed in the right-rear region, and a fourth nozzle row 15*d* arrayed in the left-rear region are disposed in each head unit 12. Each of the first to fourth nozzle rows 15*a* to 15*d* ejects ink of a different color. The first through fourth nozzle rows 15*a* to 15*d* are examples of one nozzle row and another nozzle row.

In FIG. 9, a line P1 denotes the leftmost position in the leftmost head unit 12 at which nozzles corresponding to all four colors are aligned in the front-rear direction. In other words, the line P1 passes through the leftmost nozzle in the third nozzle row 15*c* of the leftmost head unit 12. Hence, nozzles of all four colors do not overlap each other in the front-rear direction within a region disposed leftward of this line P1 in the liquid ejecting modules 11 (hereinafter called an unused region R1). In other words, not all of the first to fourth nozzle rows 15*a* to 15*d* are aligned in the front-rear direction in the unused region R1 and, hence, not all four colors are aligned in the front-rear direction with respect to the unused region R1 that constitute a left end portion of each liquid ejecting module 11. Accordingly, nozzles positioned in the unused region R1 are not used for printing.

Similarly, a line P2 in FIG. 9 denotes the rightmost position in the rightmost head unit 12 at which nozzles corresponding to all four colors are aligned in the front-rear direction. In other words, the line P2 passes through the rightmost nozzle in the second nozzle row 15*b* of the rightmost head unit 12. Hence, nozzles of all four colors do not overlap each other in the front-rear direction in a region disposed rightward of this line P2 in the liquid ejecting module 11 (hereinafter called an unused region R2). In other words, not all of the first through fourth nozzle rows 15*a* to 15*d* are aligned each other in the front-rear direction in the unused region R2 and, hence, not all four colors are aligned in the front-rear direction with respect to the unused region R2 that constitute a right end portion of each liquid ejecting module 11. Accordingly, nozzles positioned in the unused region R2 are not used for printing.

First protrusions 631 (an example of a protrusion) extend in the longitudinal direction of the second opening 16*a*. The first protrusions 631 are not disposed at positions that overlap the unused regions R1 and R2 in the up-down direction. In other words, portions of the first protrusions 631 that would occupy positions overlapping the unused regions R1 and R2 in the up-down direction have been removed. In FIG. 9, the removed portions of the first protrusions 631 are depicted with broken lines.

Here, since the nozzles 15 positioned in the unused regions R1 and R2 are unused, the first protrusions 631 are not required for protecting these unused nozzles 15. Therefore, the unnecessary portions of the first protrusions 631 are removed in the sixth embodiment to thereby reduce manufacturing costs.

Note that parts and components in the sixth embodiment having the same structure as those in the first to fifth embodiments are designated with the same reference numerals to avoid duplicating description.

Seventh Embodiment

Figure 10:
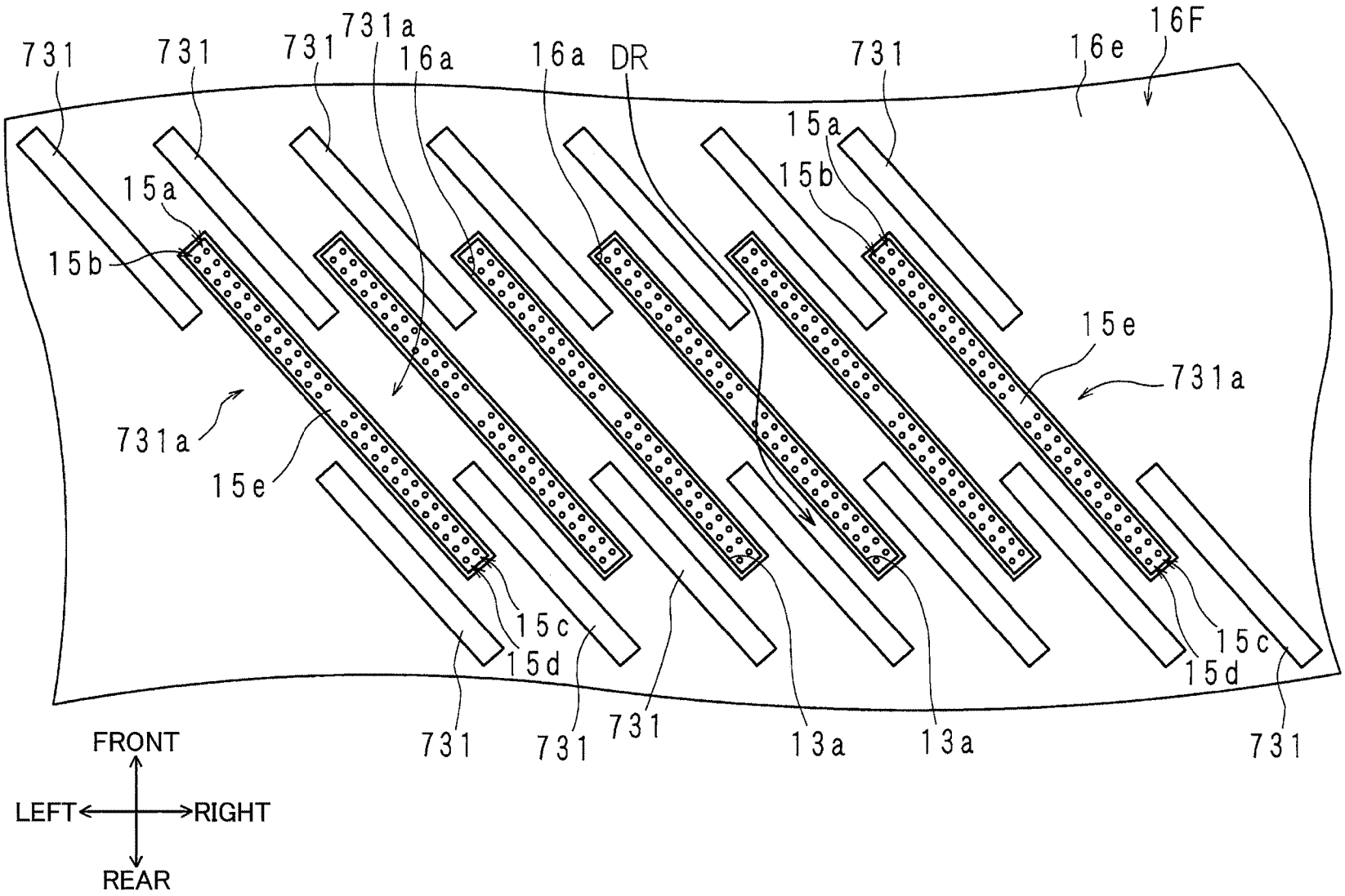
FIG. 10 is a schematic bottom view of a second plate 16F in an inkjet head 4 according to a seventh embodiment.

Next, a second plate 16F in an inkjet head 4 according to a seventh embodiment will be described with reference to FIG. 10. As illustrated in FIG. 10, the printer 1 includes the second plate 16F. The first nozzle row 15*a* arrayed in a right-front region, the second nozzle row 15*b* arrayed in the left-front region, the third nozzle row 15*c* arrayed in the right-rear region, and the fourth nozzle row 15*d* arrayed in the left-rear region are disposed in each head unit 12. Each of the first to fourth nozzle rows 15*a* to 15*d* ejects ink of a different color.

A pair of first protrusions 731 (an example of a protrusion, a first protruding portion and a protruding portion) each extending in the longitudinal direction of the second opening 16*a* is arrayed in the longitudinal direction of the second opening 16*a* on both the right side and the left side of each second opening 16*a*. A margin 15*e* is provided between the nozzle rows 15*a* and 15*b*, and the nozzle rows 15*c* and 15*d* in each head unit 12. The margins 15*e* are aligned in the left-right direction (the arraying direction of the liquid ejecting modules 11) with gaps 731*a* provided between the pairs of first protrusions 731. The margins 15*e* and the gaps 731*a* are in communication with each other in the left-right direction.

Since the margins 15*e* and the gaps 731*a* communicate with each other in the left-right direction in the seventh embodiment, some of airflow produced by the conveyed recording sheet 100 easily flows in the left-right direction therethrough. As indicated by an arrow DR in FIG. 10, some of air flowing in the front-rear direction (conveying direction of the recording sheet 100) is diverted in the left-right direction, whereby the strength of this airflow can be reduced. Further, air flowing in the conveying direction of the recording sheet 100 can escape through the margins 15*e* and gaps 31*a*.

Note that each pair of first protrusions 731 may extend in the front-rear direction (a direction perpendicular to the arraying direction of the liquid ejecting modules 11). Even with this arrangement, the strength of airflow in the conveying direction of the recording sheet 100 can be weakened provided that the margins 15*e* and the gaps 731*a* are in communication with each other in the left-right direction.

Note that parts and components in the seventh embodiment having the same structure as those in the first to sixth embodiments are designated with the same reference numerals to avoid duplicating description.

<Variations>

While the description has been made in detail with reference to the embodiments thereof, it would be apparent to those skilled in the art that various changes and modifications may be made therein without departing from the scope of the above-described embodiment. Variations of the embodiments will next be described. The direction in which the nozzle rows are arrayed is not limited to an oblique direction that intersects both the conveying direction of the recording sheet and the arraying direction of the liquid ejecting modules, but may be parallel to the arraying direction of the liquid ejecting modules.

Further, the printer according to the present disclosure is not limited to a line printer, but may be a serial printer that scans a print head in a direction intersecting the conveying direction of the recording sheet. Further, the medium conveyed in the printer is not limited to the recording sheet 100, but may be any recordable media (fabric, for example).

The area of each second opening may be the same as or even smaller than the area of each first opening. Further, the second plate need not be adhesively fixed to the first plates. For example, the second plate may be configured to be movable relative to the first plates and may be configured to contact and be engaged with the first plates during an ejection operation. Further, the protrusions need not be positioned between neighboring head units and neighboring liquid ejecting modules, but may be disposed in positions overlapped with the head units and the liquid ejecting modules.

All embodiments described above are merely examples in all aspects and should not be considered to be limiting. The technical features described in each embodiment may be combined with each other, and the scope of the present disclosure is intended to encompass all modifications within the scope of the claims and a scope equivalent to the scope of the claims.

The present disclosure exemplified in the embodiments, modification and examples described above may be summarized as follows.

(1) According to one aspect, the disclosure provides a liquid ejecting head including: a plurality of liquid ejecting modules each including a plurality of head units and a first plate, a second plate, and a protrusion. The plurality of liquid ejecting modules is arrayed in a first direction. The first plate has a first surface to which the plurality of head units is fixed and a second surface opposite to the first surface. The first plate has a thickness in a second direction. The second plate is disposed at the second surface of the first plate so as to extend along the plurality of liquid ejecting modules. The protrusion protrudes from the second plate in a direction away from the first plate.

(2) In the liquid ejecting head according to the aspect (1), it is preferable that: each of the plurality of head units includes a plurality of nozzles; the first plate is formed with a plurality of first openings each overlapped with the plurality of nozzles in the second direction; and the second plate is formed with a plurality of second openings each overlapped with each of the plurality of first openings in the second direction.

(3) In the liquid ejecting head according to the aspect (2), preferably, an outline of each of the plurality of first openings and an outline of each of the plurality of second openings are overlapped with each of the plurality of head units in the second direction.

(4) In the liquid ejecting head according to the aspect (2), preferably, when viewed in the second direction, each of the plurality of second openings has an area greater than an area of each of the plurality of first openings.

(5) In the liquid ejecting head according to any one of the aspects (2) to (4), it is preferable that: each of the plurality of second openings has a central axis extending in the second direction; each of the plurality of first openings has a central axis extending in the second direction; and the central axis of each of the plurality of second openings is offset from the central axis of each of the plurality of first openings in the first direction.

(6) In the liquid ejecting head according to any one of the aspects (2) to (5), it is preferable that: each of the plurality of second openings has one end in the first direction; and the second plate is formed with a third opening in communication with the one end in the first direction of each of the plurality of second openings.

(7) In the liquid ejecting head according to the aspect (6), it is preferable that: the one end in the first direction of each of the plurality of second openings has end portions in an arraying direction of the plurality of nozzles; and the third opening is formed at each end portion of the one end of each of the plurality of second openings in the arraying direction of the plurality of nozzles.

(8) In the liquid ejecting head according to any one of the aspects (1) to (7), it is preferable that: neighboring head units of the plurality of head units provide a first gap therebetween in the first direction; and the protrusion is overlapped with the first gap in the second direction.

(9) In the liquid ejecting head according to any one of the aspects (1) to (7), it is preferable that: neighboring liquid ejecting modules of the plurality of liquid ejecting modules provide a second gap therebetween in the first direction; and the protrusion is overlapped with the second gap in the second direction.

(10) In the liquid ejecting head according to the aspect (1), it is preferable that: each of the plurality of head units includes a plurality of nozzles arrayed in a predetermined direction to form a nozzle row; and the protrusion includes a first protrusion extending in the predetermined direction along the nozzle row.

(11) In the liquid ejecting head according to the aspect (10), preferably, the first protrusion has an end portion in the predetermined direction positioned outward of an end portion in the predetermined direction of each of the plurality of head units.

(12) In the liquid ejecting head according to the aspect (10) or (11), preferably, the protrusion further includes a second protrusion positioned outward of an end portion in the predetermined direction of the nozzle row.

(13) In the liquid ejecting head according to any one of the aspects (10) to (12), it is preferable that: the first protrusion includes a plurality of first protruding portions spaced away from each other in the predetermined direction.

(14) In the liquid ejecting head according to any one of the aspects (10) to (12), it is preferable that: the first protrusion includes a plurality of protruding portions arrayed in the predetermined direction, neighboring protruding portions of the plurality of protruding portions providing a gap therebetween; and the nozzle row of each of the plurality of head units includes a plurality of nozzle rows arrayed in the predetermined direction, neighboring nozzle rows of the plurality of nozzle rows providing a margin therebetween, the margin and the gap being aligned in the first direction.

(15) In the liquid ejecting head according to the aspect (14), preferably, each of the plurality of protruding portions extends in a direction perpendicular to the first direction.

(16) In the liquid ejecting head according to any one of the aspects (10) to (14), preferably, the predetermined direction is not coincident with the first direction and a direction perpendicular to the first direction.

(17) In the liquid ejecting head according to the aspect (1), it is preferable that: each of the plurality of head units includes a plurality of nozzles; each of the plurality of liquid ejecting modules has a used region in which the plurality of nozzles is used and an unused region in which the plurality of nozzles is unused; and the protrusion is exclusively disposed at a position overlapped with the used region in the second direction.

(18) In the liquid ejecting head according to the aspect (17), it is preferable that: each of the plurality of liquid ejecting modules includes one nozzle row including the plurality of nozzles and another nozzle row including the plurality of nozzles and positioned adjacent to the one nozzle row; and a nozzle of the one nozzle row is out of alignment with a nozzle of the another nozzle row in a direction perpendicular to the first direction with respect to the unused region.

(19) In the liquid ejecting head according to the aspect (17) or (18), it is preferable that: each of the plurality of liquid ejecting modules has end portions in the first direction; and the unused region constitutes each end portion in the first direction of each of the plurality of liquid ejecting modules.

According to the present disclosure, since the protrusion protruding toward the direction away from the first plate is provided at the second plate, a predetermined distance is provided between a recording medium and openings formed in the second plate. Accordingly, the protrusion can prevent the recording medium from entering the openings, thereby suppressing damage to the nozzles. Further, since the second plate closes gaps defined between the neighboring first plates, ink can be prevented from collecting in these gaps.

What is claimed is:

1. A liquid ejecting head comprising:

a plurality of liquid ejecting modules arrayed in a first direction, each of the plurality of liquid ejecting modules comprising:

a plurality of head units, wherein each of the plurality of head units comprises a plurality of nozzles; and a first plate having a first surface to which the plurality of head units is fixed and a second surface opposite to the first surface, the first plate having a thickness in a second direction, wherein the first plate is formed with a plurality of first openings each overlapped with the plurality of nozzles in the second direction;

a second plate disposed at the second surface of the first plate so as to extend along the plurality of liquid ejecting modules, wherein the second plate is formed with a plurality of second openings each overlapped with corresponding one of the plurality of first openings in the second direction, wherein each of the plurality of second openings has one end in the first direction, and wherein the second plate is formed with a third opening in communication with the one end in the first direction of each of the plurality of second openings; and a protrusion protruding from the second plate in a direction away from the first plate.

2. The liquid ejecting head according to claim 1, wherein an outline of each of the plurality of first openings and an outline of each of the plurality of second openings are overlapped with corresponding one of the plurality of head units in the second direction.

3. The liquid ejecting head according to claim 1, wherein, when viewed in the second direction, each of the plurality of second openings has an area greater than an area of each of the plurality of first openings.

4. The liquid ejecting head according to claim 1, wherein each of the plurality of second openings has a central axis extending in the second direction, and wherein each of the plurality of first openings has a central axis extending in the second direction, the central axis of each of the plurality of second openings being offset from the central axis of each of the plurality of first openings in the first direction.

5. The liquid ejecting head according to claim 1, wherein the one end in the first direction of each of the plurality of second openings has end portions in an arraying direction of the plurality of nozzles, and wherein the third opening is formed at each end portion of the one end of each of the plurality of second openings in the arraying direction of the plurality of nozzles.

6. The liquid ejecting head according to claim 1, wherein neighboring head units of the plurality of head units provide a first gap therebetween in the first direction, and wherein the protrusion is overlapped with the first gap in the second direction.

7. The liquid ejecting head according to claim 1, wherein neighboring liquid ejecting modules of the plurality of liquid ejecting modules provide a first gap therebetween in the first direction, and wherein the protrusion is overlapped with the first gap in the second direction.

8. The liquid ejecting head according to claim 1, wherein each of the plurality of head units comprises a plurality of nozzles arrayed in a predetermined direction to form a nozzle row, and wherein the protrusion comprises a first protrusion extending in the predetermined direction along the nozzle row.

9. The liquid ejecting head according to claim 8, wherein the first protrusion has an end portion in the predetermined direction positioned outward of an end portion in the predetermined direction of each of the plurality of head units.

10. The liquid ejecting head according to claim 8, wherein the protrusion further comprises a second protrusion positioned outward of an end portion in the predetermined direction of the nozzle row.

11. The liquid ejecting head according to claim 8, wherein the first protrusion comprises a plurality of first protruding portions spaced away from each other in the predetermined direction.

12. The liquid ejecting head according to claim 8, wherein the first protrusion comprises a plurality of protruding portions arrayed in the predetermined direction, neighboring protruding portions of the plurality of protruding portions providing a gap therebetween, and wherein the nozzle row of each of the plurality of head units comprises a plurality of nozzle rows arrayed in the predetermined direction, neighboring nozzle rows of the plurality of nozzle rows providing a margin therebetween, the margin and the gap being aligned in the first direction.

13. The liquid ejecting head according to claim 12, wherein each of the plurality of protruding portions extends in a direction perpendicular to the first direction.

14. The liquid ejecting head according to claim 8, wherein the predetermined direction is not coincident with the first direction and a direction perpendicular to the first direction.

15. The liquid ejecting head according to claim 1, wherein each of the plurality of head units comprises a plurality of nozzles, wherein each of the plurality of liquid ejecting modules has a used region in which the plurality of nozzles is used and an unused region in which the plurality of nozzles is unused, and wherein the protrusion is exclusively disposed at a position overlapped with the used region in the second direction.

16. The liquid ejecting head according to claim 15, wherein each of the plurality of liquid ejecting modules comprises one nozzle row including the plurality of nozzles and another nozzle row including the plurality of nozzles and positioned adjacent to the one nozzle row, and wherein a nozzle of the one nozzle row is out of alignment with a nozzle of the another nozzle row in a direction perpendicular to the first direction with respect to the unused region.

17. The liquid ejecting head according to claim 15, wherein each of the plurality of liquid ejecting modules has end portions in the first direction, and wherein the unused region constitutes each end portion in the first direction of each of the plurality of liquid ejecting modules.

* * * * *